US012618637B2

(12) United States Patent
Blankenbeckler et al.

(10) Patent No.: US 12,618,637 B2
(45) Date of Patent: May 5, 2026

(54) MUZZLE LOADER

(71) Applicant: James Allan Blankenbeckler, Hillsboro, IN (US)

(72) Inventors: James Allan Blankenbeckler, Hillsboro, IN (US); Tanner William Metzmeier, Sterling, VA (US); Joseph Ramsey Porter, Charlston, IL (US)

(73) Assignee: James Blankenbeckler, Hillsboro, IN (US)

( * ) Notice: Subject to any disclaimer, the term of this patent is extended or adjusted under 35 U.S.C. 154(b) by 0 days.

(21) Appl. No.: 19/080,102

(22) Filed: Mar. 14, 2025

(65) Prior Publication Data

US 2025/0290726 A1 Sep. 18, 2025

Related U.S. Application Data

(60) Provisional application No. 63/566,726, filed on Mar. 18, 2024.

(51) Int. Cl.
*F41C 9/08* (2006.01)

(52) U.S. Cl.
CPC ..... *F41C 9/08* (2013.01); *F41C 9/085* (2013.01)

(58) Field of Classification Search
CPC ..... F41C 9/08; F41C 9/085
See application file for complete search history.

(56) References Cited

U.S. PATENT DOCUMENTS

| | | | | |
|---|---|---|---|---|
| 481,887 | A * | 8/1892 | Beardsley et al. | F42B 33/001 86/30 |
| 2,321,770 | A * | 6/1943 | Persson | F42B 33/025 73/81 |
| 4,466,210 | A * | 8/1984 | Koontz | F41C 9/085 42/90 |
| 8,011,128 | B1 * | 9/2011 | Johnston | F41C 9/085 89/1.3 |
| 2005/0132890 | A1 * | 6/2005 | Constantine | A47J 31/44 99/275 |
| 2006/0005446 | A1 * | 1/2006 | Lee | F41C 9/08 42/90 |
| 2006/0162218 | A1 * | 7/2006 | Church | F41C 9/085 42/51 |
| 2011/0232147 | A1 * | 9/2011 | Zoellner | F41C 9/085 42/1.01 |
| 2013/0061507 | A1 * | 3/2013 | Hunsaker | F41C 9/085 42/90 |
| 2015/0047245 | A1 * | 2/2015 | Ervin | F41C 9/085 42/90 |
| 2016/0146570 | A1 * | 5/2016 | Grazioplene | F41C 9/085 42/51 |
| 2022/0011072 | A1 * | 1/2022 | Minnich | F41C 9/085 |
| 2025/0290726 | A1 * | 9/2025 | Blankenbeckler | F41C 9/085 |

* cited by examiner

*Primary Examiner* — Gabriel J. Klein
(74) *Attorney, Agent, or Firm* — McAndrews, Held & Malloy, Ltd.

(57) ABSTRACT

A muzzle loading system includes a ramrod and a muzzle loader. The ramrod includes ramrod body having a ramrod proximal end and a ramrod distal end. The muzzle loader receives the ramrod proximal end, applies a loading pressure to the ramrod, and provides audible and/or haptic feedback in response to the applied loading pressure reaching a target loading pressure.

10 Claims, 4 Drawing Sheets

MUZZLE LOADER

CROSS REFERENCE TO RELATED APPLICATIONS

The present application claims benefit to and priority from U.S. Provisional Application Ser. No. 63/566,726, filed Mar. 18, 2024, the disclosure of which is hereby incorporated herein by reference in its entirety.

TECHNICAL FIELD

Aspects of the present disclosure are related to loading a firearm and more specifically to loading a firearm via its muzzle.

BACKGROUND

The conventional tools and processes for muzzle loading a firearm introduce variances that have negative impacts on the performance of the firearm. In particular, the conventional process includes inserting loose powder or pellets into a barrel via the muzzle to create a charge, loading a projectile into the barrel via the muzzle, and then inserting a ramrod into the barrel via the muzzle to set the projectile into position atop the charge and compress the charge. However, compression of the loose powder or pellets of the charge is dependent upon the pressure applied to the projectile by the ramrod when seating the projectile atop the charge. Variance in such compression creates a variance in the overall height of the complete load and may also cause a variance in chamber pressure upon ignition of the charge. The pressure variance may in turn cause a speed variance in the projectile resulting in accuracy issues down range. Moreover, excessive pressure applied to the projectile via the ramrod may damage a gas check or cup on the charge side of the projectile. Such damage to the projectile may also result in accuracy issues and may prevent consistent flight of the projectile.

Further limitations and disadvantages of conventional and traditional approaches will become apparent to one of skill in the art, through comparison of such systems with aspects of the present disclosure as set forth in the remainder of the present application with reference to the drawings.

BRIEF SUMMARY OF THE DISCLOSURE

Shown in and/or described in connection with at least one of the figures, and set forth more completely in the claims, are muzzle loaders, muzzle loading systems, and methods for muzzle loading a firearm. In particular, a muzzle loader may engage a ramrod and apply pressure to the ramrod. The muzzle loader may further alert the user that a target loading pressure has been reached and/or may partially release pressure applied to the ramrod in response to the target loading pressure being reached. In this manner, the muzzle load may provide a more consistent loading pressure and chamber pressure, which may provide more consistent projectile performance. Furthermore, such alerts and/or partial release of pressure may prevent a user from inadvertently applying sufficient pressure to damage a gas check or a cup of a projectile when seating the projectile atop the charge.

These and other advantages, aspects, and novel features of the present disclosure, as well as details of illustrated embodiments thereof, will be more fully understood from the following description and drawings.

BRIEF DESCRIPTION OF THE DRAWINGS

Various features and advantages of the present disclosure may be more readily understood with reference to the following detailed description taken in conjunction with the accompanying drawings, wherein like reference numerals designate like structural elements.

DESCRIPTION

Figure 1:
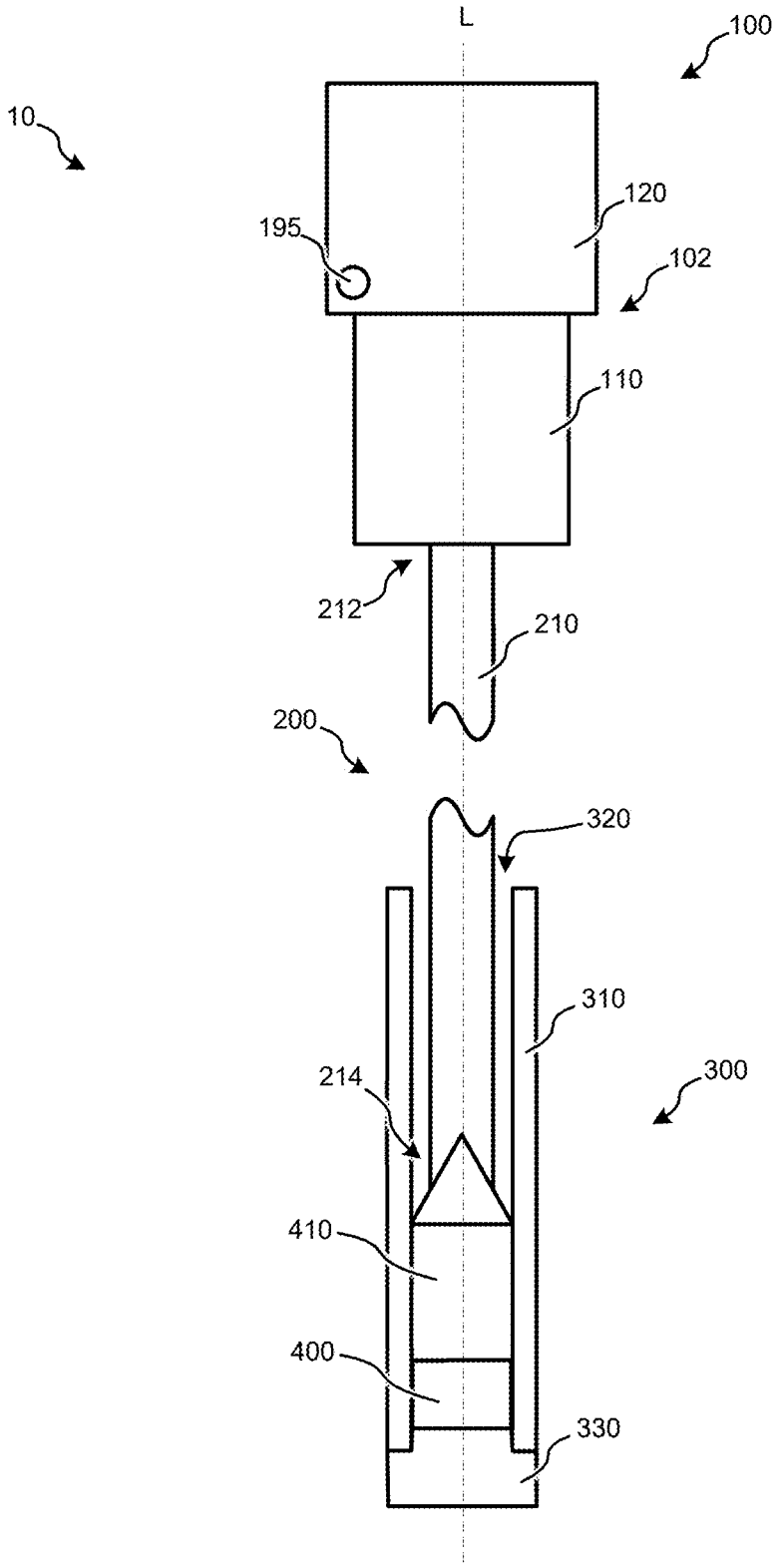
FIG. 1 depicts a muzzle-loaded firearm and a muzzle-loading system in accordance with various aspects of the present application.

The following discussion provides various examples of a muzzle-loading system, a muzzle loader, and a muzzle-loading process. In some embodiments, the muzzle-loading system includes a muzzle loader and a ramrod. During a muzzle-loading process, the muzzle loader may apply suitable force or pressure to the ramrod so as to properly seat a projectile atop a charge. To this end, the muzzle loader may include a cam, a plunger, and a spring, which cooperate to ensure a consistent loading pressure is applied to the projectile. Upon achieving a desired or target loading pressure, the muzzle loader may partially reduce pressure applied to the ramrod, may provide a user of the muzzle loader with audible feedback, and/or may provide the user of the muzzle loader with haptic feedback. Such examples are non-limiting, and the scope of the appended claims should not be limited to the particular examples disclosed. In the following discussion, the terms "example" and "e.g." are non-limiting.

The figures illustrate a general manner of construction. Descriptions and details of well-known features and techniques may be omitted to avoid unnecessarily obscuring the present disclosure. In addition, elements in the drawing figures are not necessarily drawn to scale. For example, the dimensions of some of the elements in the figures may be exaggerated relative to other elements to help improve understanding of the examples discussed in the present disclosure. The same reference numerals in different figures denote the same elements.

The term "and/or" means any one or more of the items in the list joined by "and/or". As an example, "x and/or y" means any element of the three-element set {(x), (y), (x, y)}. In other words, "x and/or y" means "one or both of x and y". As another example, "x, y, and/or z" means any element of the seven-element set {(x), (y), (z), (x, y), (x, z), (y, z), (x, y, z)}. In other words, "x, y and/or z" means "one or more of x, y and z".

The terms "comprises," "comprising," "includes," and/or "including," are "open ended" terms and specify the presence of stated features, but do not preclude the presence or addition of one or more other features.

The terms "first," "second," etc. may be used herein to describe various elements, and these elements should not be limited by these terms. These terms are only used to distinguish one element from another. Thus, for example, a first element discussed in this disclosure could be termed a second element without departing from the teachings of the present disclosure.

Unless specified otherwise, the term "coupled" may be used to describe two elements directly contacting each other or describe two elements indirectly connected by one or more other elements. For example, if element A is coupled to element B, then element A can be directly contacting element B or indirectly connected to element B by an intervening element C. Similarly, the terms "over" or "on" may be used to describe two elements directly contacting each other or describe two elements indirectly connected by one or more other elements.

Referring now to FIG. 1, an example embodiment of a muzzle-loading system 10 is shown. The muzzle-loading system 10 may include a muzzle loader 100 and a ramrod 200. The ramrod 200 may include a ramrod body 210 sized to permit insertion of the ramrod 200 into a ramrod receiving port 112 of the muzzle loader 100 and to permit insertion into a barrel 310 of a muzzle-loading firearm 300. In particular, the ramrod body 210 and its ramrod proximal end 212 may have a slightly smaller diameter than an inner diameter of the ramrod receiving port 112 of the muzzle loader 100. Such configuration permits inserting the ramrod proximal end 212 into the muzzle loader 100 via its ramrod receiving port 112. Such insertion may cause the ramrod proximal end 212 to engage and move a plunger 130 of the muzzle loader 100 during a muzzle-loading process.

In various embodiments, an outer surface of the ramrod proximal end 212 may include threads which may engage threads of the plunger 130 and permit screwing the ramrod proximal end 212 into the plunger 130. Such threaded engagement may aid in securing the ramrod 200 to the plunger 130 and ensure the plunger 130 and ramrod 200 move in tandem with one another. Other embodiments may secure or otherwise couple the ramrod 200 to the plunger 130 via other mechanisms such as pressure fitting, linchpin, and/or other fasteners.

The ramrod body 210 and its ramrod distal end 214 may have a slightly smaller diameter than an inner diameter of the barrel 310. Such configuration permits inserting the ramrod distal end 214 into the barrel 310 via its muzzle 320. Moreover, the ramrod 200 may traverse through the barrel 310 toward a breech plug 330 of the muzzle-loading firearm 300. In some embodiments, the ramrod distal end 214 may have a concave shape designed to engage and closely-mate a convex muzzle side surface of a projectile 410. Such concave shape may evenly distribute, to muzzle side surface of the projectile 410, a loading pressure supplied by the muzzle loader 100 via the ramrod 200.

In operation, a user may insert loose powder and/or pellets into the barrel 310 via the muzzle 320, thus creating a charge 400 atop the breech plug 330 of the firearm 300. Then, the user may insert a projectile 410 into the barrel 310 via the muzzle 320, thus positioning the projectile 410 atop the charge 400. After creating the charge 400 and inserting the projectile 410, the user may insert the ramrod distal end 214 into the barrel 310 via the muzzle 320 and may push the ramrod distal end 214 toward the breech plug 330 so as to engage the projectile 410 atop the charge 400. The user may engage the muzzle loader 100 with the ramrod 200 by inserting the ramrod proximal end 212 inserted into the ramrod receiving port 112. The user may then push the muzzle loader 100 toward the breech plug 330, thus transferring force to the projectile 410 and compressing loose powder and/or pellets of the charge 400.

As explained in greater detail below, components of the muzzle loader 100 may react to the force applied to the ramrod 200 via the muzzle loader 100. In particular, in response to a target loading pressure being applied, the muzzle loader 100 may partially release or reduce the applied pressure so as to prevent over compression of the projectile 410 and the charge 400. Moreover, the muzzle loader 100 may provide the user with audible feedback and/or haptic feedback in response to reaching the target loading pressure. Such feedback may inform the user that the target loading pressure has been achieved and that the user may cease further pushing of the muzzle loader 100 toward the breech plug 330. After loading, the user may pull the muzzle loader 100 away from the breech plug 330 to extract the ramrod 200 from the barrel 310. Such pulling may reset internal components of the muzzle loader 100 for a subsequent loading of the firearm 300.

Figure 2C:
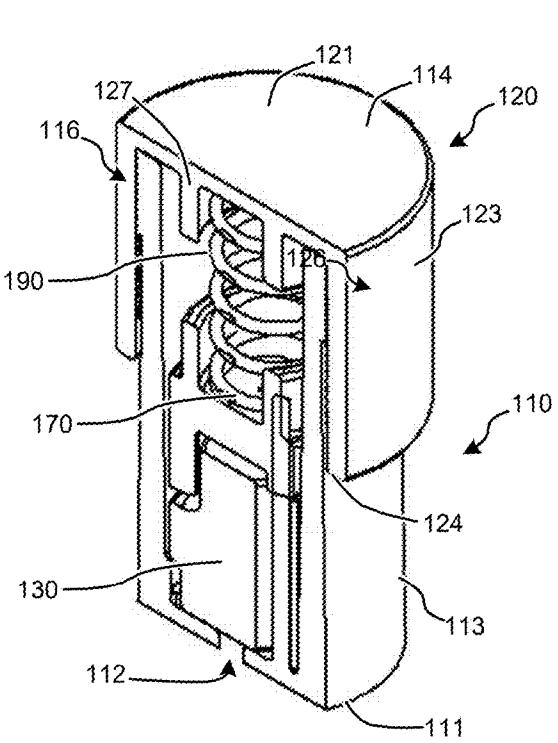
FIGS. 2A-2D provide various views for a muzzle loader of the muzzle loading system depicted in FIG. 1.
Figure 2D:
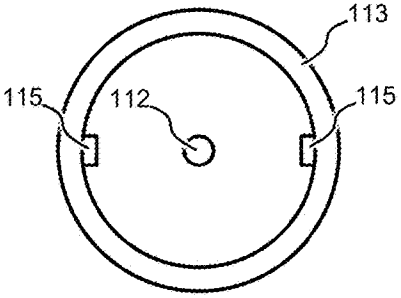
Figure 2B:
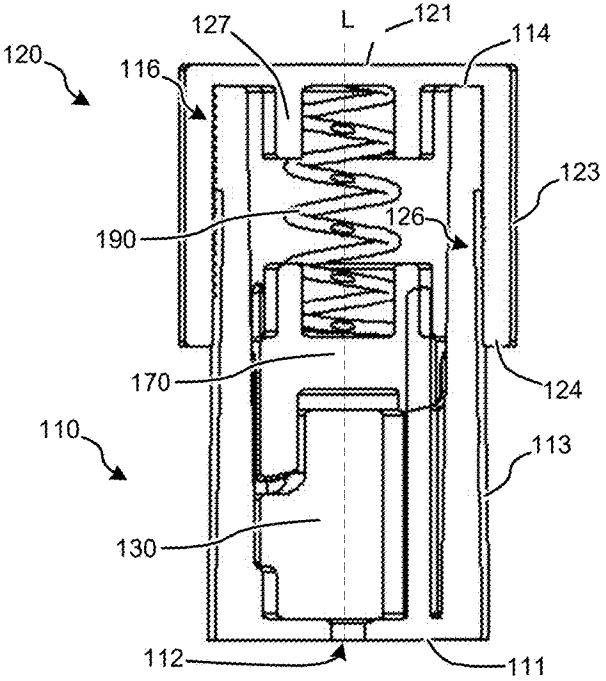
Figure 2A:
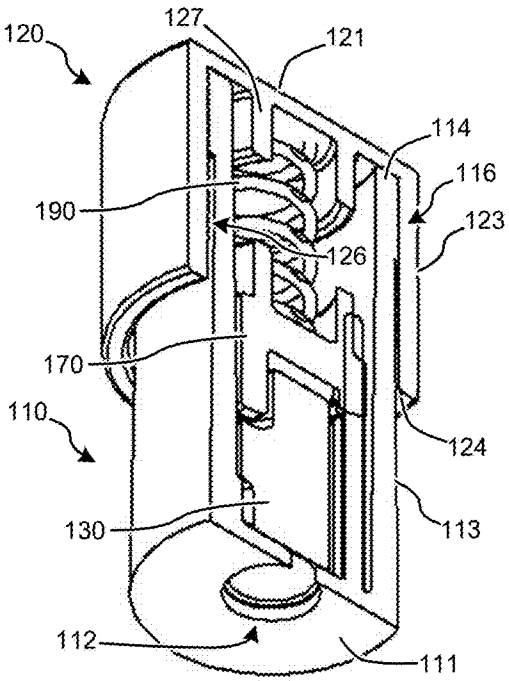

Turning now to FIGS. 2A-2D, details regarding the construction of the muzzle loader 100 are presented. In particular, FIGS. 2A-2C provide vertical cross-sectional views of the muzzle loader 100 when in an initial resting or uncompressed position. FIG. 2D provides a horizontal cross-sectional view of an enclosure 102 of the muzzle loader 100. As shown, the enclosure 102 may include an enclosure body 110 associated with the enclosure bottom side and muzzle loader bottom side and an enclosure cap 120 associated with the enclosure top side and muzzle loader top side. The muzzle loader 100 may further include a plunger 130, a cam 170, and one or more springs 190 within the enclosure 102.

The enclosure body 110 may include a hollow, cylindrical-shaped enclosure for housing the plunger 130, the cam 170, and the one or more springs 190. In particular, the enclosure body 110 may include an enclosure body bottom 111 and enclosure body sidewalls 113 that extend upward from the enclosure body bottom 111 to an enclosure body upper rim 114. In various embodiments, the enclosure body bottom 111 may be circular in shape, though other shapes are possible. As shown, the ramrod receiving port 112 may pass through the enclosure body bottom 111. In various embodiments, the ramrod receiving port 112 may pass through the radial center of the enclosure body bottom 111.

As further shown, the enclosure body 110 may include one or more enclosure body guides 115 that extend longitudinally along an inner surface of the enclosure body sidewalls 113. See, e.g., FIG. 2D. The one or more enclosure body guides 115 may engage and guide the plunger 130 and/or the cam 170. In particular, the one or more enclosure body guides 115 may permit longitudinal movement of the plunger 130 and/or the cam 170 between the enclosure bottom side and the enclosure top side. The one or more enclosure body guides 115 may further prevent rotation of the plunger 130 and/or the cam 170 about a longitudinal axis L of the enclosure 102. Each enclosure body guide 115 may extend from a guide lower end at or near the enclosure body bottom 111 toward a guide upper end that is below an enclosure body upper rim 114. In various embodiments, the upper end of each enclosure body guide 115 is inclined to match radially-inclined surfaces 178 of the cam 170 which may aid in rotating the cam 170 when the cam 170 rests upon the upper ends of each enclosure body guide 115. In particular, the one or more enclosure body guides 115 may prevent rotation of the cam 170 until the cam 170 is positioned above the guide upper ends. At which point, due to the downward force applied by the one or more springs 190 and engagement of the radially-inclined surface 178 with inclined upper ends of the enclosure body guides 115 and plunger detents 137, the cam 170 may rotate and move away from the enclosure top, thus releasing pressure applied by the one or more springs 190. Thus, a target loading pressure may correspond to a compression of the one or more springs 190 associated with the point at which the cam 170 clears the guide upper ends.

The enclosure cap 120 may include a hollow, cylindrical-shaped enclosure for covering the enclosure body 110 and encasing the plunger 130, the cam 170, and the one or more springs 190 within the enclosure 102. In particular, the enclosure cap 120 may include an enclosure cap top 121 and enclosure cap sidewalls 123 that extend downward from the enclosure cap top 121 to an enclosure cap lower rim 124. In various embodiments, the enclosure cap top 121 may be circular in shape, though other shapes are possible.

An inner diameter of the enclosure cap 120 may be slightly larger than an outer diameter of the enclosure body 110. In this manner, the enclosure cap 120 may receive and closely mate with the enclosure body 110. In particular, an inner surface of the enclosure cap sidewalls 123 may include enclosure cap threads 126 configured to engage enclosure body threads 116 of the enclosure body 110. As such, the enclosure cap 120 may be screwed onto the enclosure body 110. In particular, FIGS. 2A-2C depict the enclosure cap 120 fully screwed onto the enclosure body 110 such that the enclosure body upper rim 114 abuts a lower surface of the enclosure cap top 121. However, as shown, the enclosure cap threads 126 substantially traverse a length of the enclosure cap sidewalls 123. As such, the enclosure cap 120 may be secured to the enclosure body 110 without screwing the enclosure cap 120 fully down upon the enclosure body 110.

In particular, compression of the one or more springs 190 and an associated target loading pressure provided by the muzzle loader 100 may be adjusted by adjusting the enclosure cap 120 with respect to the enclosure body 110. Namely, a target loading pressure provided by the muzzle loader 100 may be increased by screwing the enclosure cap 120 further down upon the enclosure body 110. Conversely, the target loading pressure provided by the muzzle loader 100 may be reduced by partially unscrewing the enclosure cap 120 from the enclosure body 110.

Thus, by "tightening" or "loosening" the enclosure cap 120, the target loading pressure may be respectively increased or decreased as desired. Moreover, the length of the enclosure cap sidewalls 123 and associate span of threads 126 may define an adjustable range of the muzzle loader 100. Furthermore, the pitch of the threads 116, 126 may affect how finely the target loading pressure may be adjusted, with finer thread pitch providing an ability to make finer adjustments. Finally, in some embodiments, the muzzle loader 100 may include a locking screw 195 which may pass through the enclosure cap 120 and engage the enclosure body 110 to effectively prevent further rotation of the enclosure cap 120 with respect to the enclosure body 110. In this manner, once the muzzle loader 100 is adjusted to provide a desired target loading pressure, the locking screw 195 may be insert to prevent inadvertent changes to the target loading pressure.

As further shown in FIGS. 2A-2C, the enclosure cap 120 may include a spring upper seat 127 along a bottom surface of the enclosure cap top 121. In particular, the spring upper seat 127 may include a ring that is radially-centered along the bottom surface of the enclosure cap top 121 and that protrudes below the bottom surface of the enclosure cap top 121. Moreover, the radially-centered ring may have an inner diameter that is slightly larger than an outer diameter of the one or more springs 190.

Similarly, as shown in FIGS. 2A-2C & 3A-3C, the cam 170 may include a spring lower seat 177 along a cam top side 172. In particular, the spring lower seat 177 may include a ring that is radially-centered along the cam top side 172 and that protrudes above the cam top side 172. Moreover, the radially-centered ring may have an inner diameter that is slightly larger than the outer diameter of the one or more springs 190.

In this manner, the spring upper seat 127 and the spring lower seat 177 may respectively receive and retain upper and lower ends of the one or more springs 190. Through their retention of the upper and lower ends of the one or more springs 190, the spring upper seat 127 and the spring lower seat 177 may maintain the one or more springs 190 in a radially-centered position within the enclosure 102. In particular, the spring upper seat 127 and the spring lower seat may maintain the position of the one or more springs 190 during longitudinal movement of the plunger 130 and the cam 170 along the longitudinal axis L of the enclosure 102 and/or rotational movement of the cam 170 about the longitudinal axis L of the enclosure 102.

Figure 3C:
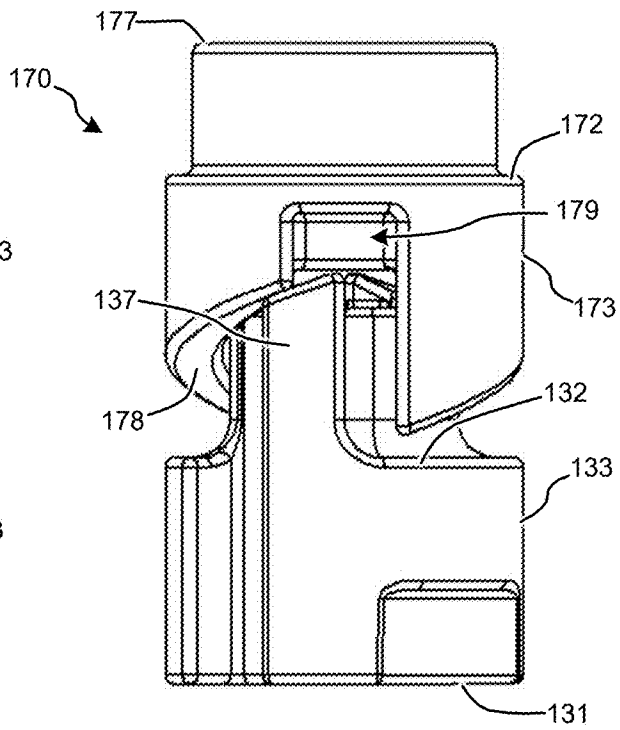
FIGS. 3A-3C provide various views for a plunger and a cam of the muzzle loader depicted in FIGS. 2A-2D.
Figure 3B:
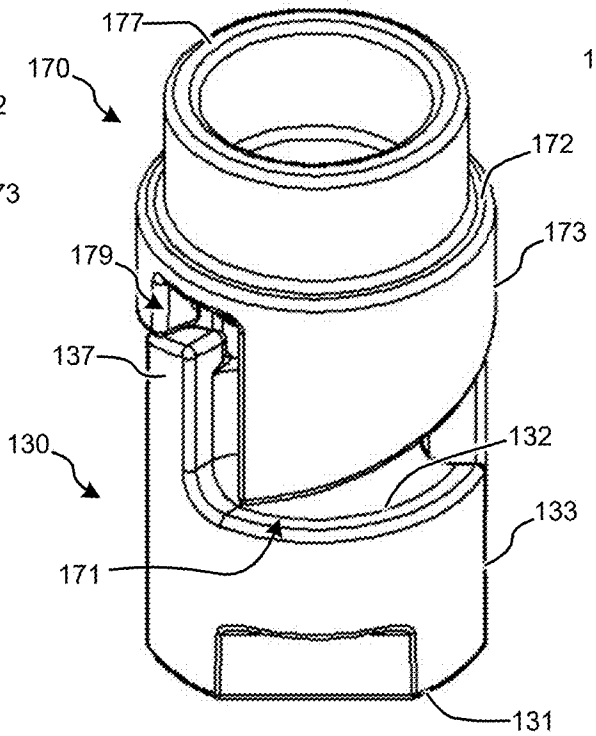
Figure 3A:
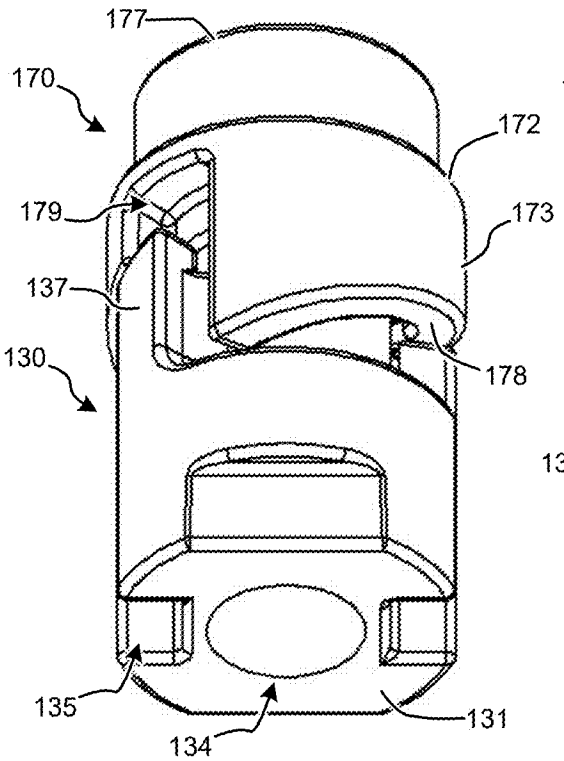

Turning now to FIGS. 3A-3C, further aspect of the plunger 130 and the cam 170 are presented. In particular, the cam 170 may include a cam bottom side 171, a cam top side 172, and cam sidewalls 173 between the cam bottom side 171 and the cam top side 172. As mentioned above, the cam top side 172 may include the spring lower seat 177, which retains the lower end of the one or more springs 190. The cam bottom side 171 may include one or more radially-inclined surfaces 178 (e.g., two radially-inclined surfaces are depicted) between one or more cam catches 179. As a result of such radially-inclined surfaces 178, the cam sidewalls 173 are longer at a starting end of each radially-inclined surface 178 and shorter at terminating end of each radially-inclined surface 178. Moreover, each cam catch 179 may be positioned between a starting end of one radially-inclined surface 178 and the terminating end of another radially-inclined surface 178. As shown, each cam catch 179 may be recessed with respect to the surrounding radially-inclined surfaces 178. Moreover, each cam catch 179 may be sized and positioned to receive a respective plunger detent 137 of the plunger 130 once a target loading pressure is reached and a respective upper end of an enclosure body guide 115 once the cam 170 is reset to its initial resting position.

The plunger 130 may include a plunger bottom side 131, a plunger top side 132, and plunger sidewalls 133 between the plunger bottom side 131 and plunger top side 132. As shown, the plunger bottom side 131 may include a ramrod seat 134. The ramrod seat 134 may include a cylindrical recess in the plunger bottom side 131 that is coaxially aligned with the ramrod receiving port 112 of the enclosure 102. Similar to the ramrod receiving port 112, the ramrod seat 134 may have an inner diameter that is slightly larger than an outer diameter of the ramrod proximal end 212. In various embodiments, an inner surface of the ramrod seat 134 may include threads configured to engage threads of the ramrod proximal end 212, thus permitting the ramrod 200 to be secured to the plunger 130 by screwing the ramrod proximal end 212 into the ramrod seat 134.

Furthermore, the recess of the ramrod seat 134 may not pass completely through the plunger 130, thus providing an upper surface that may press against an end surface of the ramrod proximal end 212. As such, the plunger 130 may receive and secure the ramrod proximal end 212 via its ramrod seat 134. Thus, the plunger 130 may apply pressure to a projectile 410 via a ramrod 200 seated in muzzle loader 100 when the muzzle loader 100 is pushed toward the breech plug 330. Further, the ramrod 200 may pull the plunger 130 toward a bottom of the muzzle loader 100 when the muzzle loader 100 is pulled away from the breech plug 330 in order to extract the ramrod 200 from the barrel 310.

As further shown in FIG. 3A, the plunger 130 may include one or more plunger channels 135 (two opposing plunger channels 135 are depicted) that pass through the plunger bottom side 131 and the plunger top side 132 and that create one or more recesses in the plunger sidewalls 133. The one or more plunger channels 135 may be sized and arranged along the plunger sidewalls 133 so as to receive and closely mate with the one or more enclosure body guides 115. Such engagement of the one or more enclosure body guides 115 with the one or more plunger channels 135 may permit the plunger 130 to slide along the enclosure body guides 115 and along the longitudinal axis L of the enclosure 102. However, such engagement of the one or more enclosure body guides 115 with the one or more plunger channels 135 may prevent rotation of the plunger 130 about the longitudinal axis L.

Furthermore, while such engagement may permit longitudinal movement of the plunger 130 within the enclosure 102, the enclosure 102, the plunger 130, and the cam 170 may be sized such that the plunger 130 is unable slide longitudinal beyond the upper ends of the enclosure body guides 115. Thus, unlike the cam 170 which may rotate about the longitudinal axis L when positioned beyond the enclosure body guides 115, the plunger 130 may be confined to longitudinal motion between the enclosure body bottom 111 and the enclosure cap top 121.

As further shown, the plunger 130 may further include one or more plunger detents 137 (e.g., two detents 137 are depicted) that extend upwardly from the plunger top side 132. An upper surface of each plunger detent 137 may be inclined at a same angle as the radially-inclined surfaces 178 of the cam 170 so that the radially-inclined surfaces 178 may rest upon and closely match the upper surface of each plunger detent 137. Such engagement of the inclined surfaces of the plunger detents 137 and the cam 170 may impart a radial force upon the cam 170, thus permitting rotation of the cam 170 once the cam 170 is free of the one or more enclosure body guides 115.

FIGS. 3A-3C depict the plunger 130 with plunger detents 137 and the cam 170 with radially-inclined surfaces 178 and cam catches 179. However, in some embodiments, the location of the detents, radially-inclined surfaces, and catches may be reversed. Namely, the plunger top side 172 may include radially-inclined surfaces and catches, whereas the cam bottom side 171 may include a detent. The operation of such an embodiment is effectively the same, merely the mating surfaces of the plunger 130 and the cam 170 are swapped.

Figures 4A, 4B, 4C, 4D:
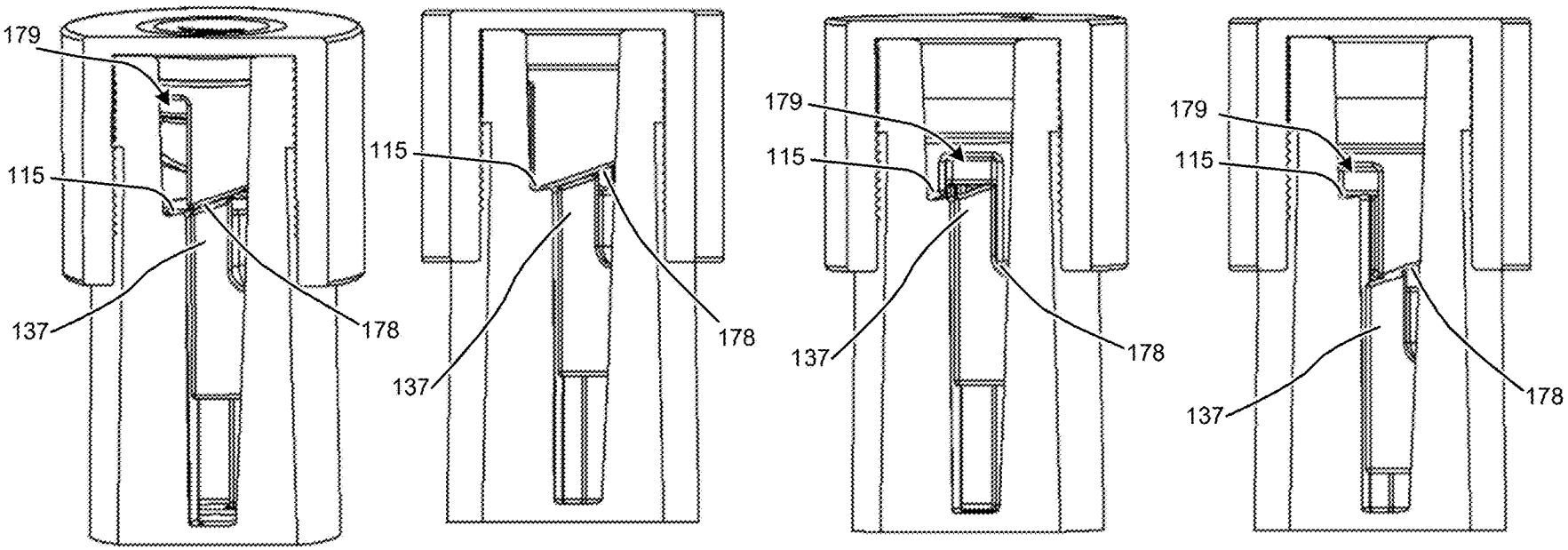
FIGS. 4A-4D depict an interaction of the plunger and the cam of FIGS. 3A-3C through various stages of muzzle loading.

FIGS. 2A-2C depict the plunger 130 and the cam 170 in an initial resting position in which the one or more springs 190 force the plunger 130 and the cam 170 toward the enclosure bottom side. Conversely, interaction between the plunger 130 and the cam 170 during operation of the muzzle loader 100 is depicted in FIGS. 4A-4D. In particular, during operation, the ramrod proximal end 212 may be inserted into the muzzle loader 100 and secured to the plunger 130 (e.g., via screwing the ramrod proximal end 212 into the ramrod seat 134). As shown in FIG. 4A, downward pressure applied the enclosure 102 may overcome the force of the one or more springs 190 and cause the ramrod 200 to move the plunger 130 toward the enclosure cap 120. As the plunger 130 moves upward toward the enclosure cap 120, the enclosure body guides 115 may engage the plunger channels 135 and lateral sides of the cam catches 179. As such, the enclosure body guides 115 may prevent rotation of the plunger 130 and the cam 170 within the enclosure 102. However, once the plunger 130 and the cam 170 reach a target loading pressure position of FIG. 4A, the cam 170 is permitted to rotate due to the radially-inclined surfaces 178 of the cam 170 clearing the inclined upper end of each enclosure body guide 115.

FIG. 4B depicts the cam 170 after the radially-inclined surfaces 178 of the cam 170 clear the upper end of each enclosure body guide 115 and the cam 170 has rotated partially toward its pressure released position. FIG. 4C depicts the cam 170 after the radially-inclined surfaces 178 of the cam 170 clear the upper end of each enclosure body guide 115 and the cam 170 has rotated fully toward its pressure released position. As may be seen in FIGS. 4A-4C, the cam 170, due to its radially-inclined surfaces 178 and its rotation within the enclosure 102, may slide longitudinally downward along the longitudinal axis L of the enclosure 102 toward the bottom of the enclosure 102. Such downward movement of the cam 170 may partially release or reduce the spring force applied to the plunger 130 and the ramrod 200 secured to the muzzle loader 100 via the plunger 130. Such partial release or reduction of the spring force may provide the user with haptic feedback, which informs the user that the target loading pressure has been reached. Furthermore, the rotation of the cam 170 from the target loading pressure position of FIG. 4A to the pressure released position of FIG. 4C may occur rapidly, thus resulting in lateral sides of the cam catches 179 snapping into contact with lateral sides of the plunger detents 137. Such snapping into position may produce an audible noise such as a click. Again, such audible feedback may inform the user that the target loading pressure has been reached.

For example, in one embodiment, the cam 170 may move downward by approximately 0.5 inches once the cam 170 clears the upper end of each enclosure body guide 115. Such downward movement increases the separation between the cam 170 and the enclosure top by about 0.5 inches. Since the one or more springs 190 are seated between the enclosure top and the cam 170, the one or more springs 190 may decompress by about 0.5 inches and thus may remove a spring force associated with a linear decompression of about 0.5 inches from the plunger 130 and the ramrod 200 secured to plunger 130.

In response to the haptic and/or audible feedback signaling that the target loading pressure has been reached, the user may stop providing downward force upon the muzzle loader 100 and may remove the muzzle loader 100 and ramrod 200 from the barrel 310 of the firearm. As a result of using the muzzle loader 100 to pull or extract the ramrod 200 from the barrel 310, the ramrod 200 may pull the plunger 130 toward the bottom of the enclosure 102. Once the plunger detents 137 clear the radially-inclined surfaces 178 of the cam 170, the cam 170 is once again free to rotate within the enclosure 102. In particular, the inclined upper ends of the enclosure body guides 115 may engage the radially-inclined surfaces 178 of the cam 170 and cause the cam 170 to rotate toward its resting position. Specifically, the cam catches 179 may rotate into position over the inclined upper ends of the enclosure body guides 115 and the inclined upper ends of the enclosure body guides 115 may slide into the recesses of the cam catches 179, thus returning the cam 170 to its resting position and effectively resting the muzzle loader 100 for its next muzzle loading procedure. See, e.g., FIG. 4D which depicts the plunger 130 and the cam 170 upon their full return to the resting position.

The present disclosure includes reference to certain examples, however, it will be understood by those skilled in the art that various changes may be made and equivalents may be substituted without departing from the scope of the disclosure. In addition, modifications may be made to the disclosed examples without departing from the scope of the present disclosure. Therefore, it is intended that the present disclosure not be limited to the examples disclosed, but that the disclosure will include all examples falling within the scope of the appended claims.

What is claimed is:

1. A muzzle loader for muzzle-loading a firearm, comprising:

an enclosure comprising an enclosure top side, an enclosure bottom side, one or more guides between the enclosure top side and the enclosure bottom side, and a ramrod receiving port through the enclosure bottom side;

a plunger in the enclosure, the plunger comprising a plunger top side, a plunger bottom side, and a ramrod seat along the plunger bottom side;

a cam comprising a cam top side, a cam bottom side, and one or more radially-inclined surfaces along the cam bottom side; and one or more springs between the enclosure top side and the cam top side that bias the plunger and the cam toward the enclosure bottom side;

wherein the one or more guides engage the plunger and the cam and prevent rotation of the plunger and the cam within the enclosure;

wherein the plunger and the cam are configured to move longitudinally toward the enclosure top side in response to pressure applied to the plunger via the ramrod receiving port; and wherein the cam is configured to rotate and partially release the pressure applied to the plunger in response to the pressure applied to plunger reaching a target loading pressure.

2. The muzzle loader of claim 1, wherein the plunger and the cam provide audible feedback when the target loading pressure is reached.

3. The muzzle loader of claim 1, wherein the plunger and the cam provide haptic feedback when the target loading pressure is reached.

4. The muzzle loader of claim 1, wherein:

the enclosure comprises an enclosure body with threads toward a rim of the enclosure body;

the enclosure comprises an enclosure cap with threads toward a rim of the enclosure cap; and the enclosure cap is screwed onto the enclosure body via the threads of the enclosure body and the enclosure cap.

5. The muzzle loader of claim 4, wherein the target loading pressure is increased by further screwing the enclosure cap onto the enclosure body.

6. The muzzle loader of claim 4, wherein the target loading pressure is decreased by partially unscrewing the enclosure cap from the enclosure body.

7. The muzzle loader of claim 1, wherein target loading pressure is adjustable.

8. The muzzle loader of claim 1, wherein the one or more guides engage one or more channels of the plunger and prevent the plunger from rotating within the enclosure.

9. The muzzle loader of claim 1, wherein:

the cam comprises a cam catch along the cam bottom side; and the one or more guides engage a lateral side of the cam catch and prevent the cam from rotating within the enclosure until the one or more guides disengage the lateral side of the cam.

10. The muzzle loader of claim 1, wherein an upper end of each of the one or more guides is inclined to match one or more radially-inclined surfaces of the cam.

* * * * *